US009290002B2

(12) United States Patent
Kubota

(10) Patent No.: US 9,290,002 B2
(45) Date of Patent: Mar. 22, 2016

(54) LIQUID STORAGE CONTAINER

(71) Applicant: Seiko Epson Corporation, Tokyo (JP)

(72) Inventor: Tomoo Kubota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/674,878

(22) Filed: Mar. 31, 2015

(65) Prior Publication Data

US 2015/0273846 A1 Oct. 1, 2015

(30) Foreign Application Priority Data

Apr. 1, 2014 (JP) ..... 2014-075190

(51) Int. Cl.
*B41J 2/175* (2006.01)
*B41J 2/14* (2006.01)

(52) U.S. Cl.
CPC ..... *B41J 2/17526* (2013.01)

(58) Field of Classification Search
CPC .. B41J 2/17503; B41J 2/1752; B41J 2/17526; B41J 2/17553
USPC ..... 347/49, 50, 86, 87
See application file for complete search history.

(56) References Cited

U.S. PATENT DOCUMENTS

| | | | | |
|---|---|---|---|---|
| 6,196,670 | B1 * | 3/2001 | Saruta | 347/86 |
| 7,971,977 | B2 * | 7/2011 | Nakata et al. | 347/86 |
| 8,591,015 | B2 * | 11/2013 | Kodama et al. | 347/86 |
| 2012/0256991 | A1 | 10/2012 | Kodama et al. | |

FOREIGN PATENT DOCUMENTS

| | | | |
|---|---|---|---|
| CN | 103101317 | A | 5/2013 |
| JP | 2012-218287 | A | 11/2012 |

* cited by examiner

*Primary Examiner* — Anh T. N. Vo

(57) ABSTRACT

With an ink cartridge mounted on a cartridge mounting section of a printer, an apparatus-side terminal elastically comes in contact with a container-side terminal of a container-side circuit substrate. The container-side terminal includes a curved edge portion at a corner portion in which a groove of a substrate surface comes in contact with a substrate end surface. Depths of the grooves in container-side terminals are different and positions of contact sections with the apparatus-side terminals are different in the edge portions. As a result, positions in directions in which elastic forces act from the apparatus-side terminals are different for each contact section and the elastic forces having values and directions which are not uniform act on the container-side circuit substrate at different positions. Thus, it is possible to suppress positional shift of the container-side circuit substrate and to suppress contact failure between the container-side terminal and the apparatus-side terminal.

9 Claims, 10 Drawing Sheets

(PRIOR ART)

LIQUID STORAGE CONTAINER

CROSS-REFERENCE TO RELATED APPLICATION(S)

This application claims priority to Japanese Patent Application No. 2014-075190 filed on Apr. 1, 2014, the entire disclosure of which is incorporated by reference herein.

BACKGROUND

1. Technical Field

The present invention relates to a technique in which a terminal electrically connected to a circuit substrate provided in a liquid storage container and a terminal provided in a mounting section on which the liquid storage container is mounted can be electrically connected.

2. Related Art

In the related art, in a printer (liquid ejecting apparatus) including a print head (liquid ejecting section) ejecting liquid such as ink, a cartridge (liquid storage container) charged with liquid is mounted on a cartridge mounting section of an apparatus body and the liquid can be supplied to the printer. A circuit substrate provided with a memory capable of recording information regarding the ink or a circuit element to which a voltage is applied from a printer side is mounted on the cartridge (liquid storage container). When the cartridge is mounted on the cartridge mounting section, a terminal (container-side terminal) electrically connected to the circuit substrate comes in contact with a terminal (apparatus-side terminal) provided in the cartridge mounting section, and the cartridge and the printer are electrically connected. A printer that is an example of such a type of liquid ejecting apparatus is disclosed in JP-A-2012-218287.

The liquid ejecting apparatus of JP-A-2012-218287 includes a cartridge mounting section and a circuit substrate (container-side circuit substrate) which is provided on a side surface of the cartridge mounted on the cartridge mounting section. A plurality of terminals (container-side terminals) are disposed in two upper and lower lines in the circuit substrate. Meanwhile, the cartridge mounting section is provided with an apparatus-side circuit substrate and a terminal module, and the apparatus-side terminals corresponding to the container-side terminals are disposed in the terminal module. The apparatus-side circuit substrate can be electrically connected to the container-side terminals through terminals (apparatus-side terminals) of the terminal module. The apparatus-side terminals are elastically held in a slit formed in a housing of the terminal module. A substantially triangular protrusion section protruding in a direction from the terminal module side to the cartridge side is formed at the leading end of the apparatus-side terminal in a state where the cartridge is mounted on the cartridge mounting section. The protrusion sections are arranged in two upper and lower lines corresponding to the container-side terminals.

Here, as disclosed in Chinese Patent Application No. 201210548626.7, there is a desire to dispose container-side terminals for saving space to reduce the size of a container-side circuit substrate in a cartridge. However, in order to save space in the container-side terminals, if the sizes of the terminals are simply reduced or intervals between the terminals are narrowed, there is a concern that contact failure with the apparatus-side terminals occurs or a failure such as short circuiting between adjacent terminals occurs. Thus, in order to avoid such an inconvenience, the container-side terminals are disposed on an end surface of the container-side circuit substrate and the container-side terminals come in contact with one lower line of two upper and lower lines of the apparatus-side terminals using an edge portion of the end surface, and thereby space saving is proposed.

FIGS. 10A to 10C are explanatory views illustrating a contact state between an apparatus-side terminal and a container-side terminal in the related art. FIG. 10A is a perspective view of a container-side circuit substrate, FIGS. 10B and 10C are explanatory views illustrating the contact state between the apparatus-side terminal and the container-side terminal (respectively corresponding to a cross-sectional view that is taken along line XB-XB and a cross-sectional view that is taken along ling XC-XC of FIG. 10A). As illustrated in FIG. 10A, a plurality of grooves 201 are formed in one line on an end surface of a container-side circuit substrate 200. Contact surfaces 202 including contact sections that come in contact with the apparatus-side terminals are formed in the grooves 201. The contact surface 202 is formed of a conductive layer of copper and the like. A configuration of the cartridge mounting section is similar to that of JP-A-2012-218287 and apparatus-side terminals 210A and 210B having elasticity are disposed in two upper and lower lines. A substantially triangular protrusion section is provided in a leading end portion of each of the apparatus-side terminals 210A and 210B, and an inclined section 211 is provided in the protrusion section. If the cartridge is mounted on the cartridge mounting section, the upper line apparatus-side terminal 210A comes in contact with an upper portion of the contact surface 202 (see FIG. 10B) and the inclined section 211 of the lower line apparatus-side terminal 210B comes in contact with the edge portion (corner portion in which the end surface of the substrate comes in contact with a surface of the substrate) of the lower portion of the contact surface 202 (see FIG. 10C).

In the contact state of the related art illustrated in FIGS. 10A to 10C, the edge portion of the lower portion of the contact surface 202 of the container-side terminal comes in contact with the apparatus-side terminal 210B (apparatus-side terminal) of the lower line. Thus, it is possible to dispose the container-side terminals with respect to the container-side circuit substrate 200 for saving space. However, in this case, an elastic force F0 of the apparatus-side terminal 210A of the upper line acts perpendicular to the contact surface 202, whereas an elastic force F of the apparatus-side terminal 210B of the lower line acts obliquely to the contact surface 202. At this time, the elastic force F includes a component force F1 perpendicular to the contact surface 202 and a component force F2 parallel to the contact surface 202. As a result, for example, the container-side circuit substrate 200 is shifted in a direction in which the component force F2 acts and thereby there is a problem that the contact failure occurs. Furthermore, the elastic force F is divided into the component force F1 and the component force F2, and F1 that is a force for pressing the apparatus-side terminal 210B to the contact surface 202 is smaller than the elastic force F. As a result, for example, if the cartridge is vibrated due to a printing operation and the like, a positional shift of the container-side circuit substrate 200 due to the vibration occurs and there is a problem that the contact failure occurs.

SUMMARY

An advantage of some aspects of the invention is to provide a liquid storage container in which contact failure between a container-side terminal electrically connected to the liquid storage container and an apparatus-side terminal provided in a mounting section of the liquid storage container can be suppressed.

According to an aspect of the invention, there is provided a liquid storage container that is capable of being mounted on a mounting section of a liquid ejecting apparatus having an apparatus-side terminal group that has elasticity and is provided such that a first apparatus-side terminal and a second apparatus-side terminal form one line, the liquid storage container including: a container-side terminal group that includes a first terminal having a first contact section to come in contact with the first apparatus-side terminal and a second terminal having a second contact section that comes in contact with the second apparatus-side terminal. When the direction of an elastic force acting on the first contact section from the first apparatus-side terminal is a direction of elasticity, the position of the first contact section is different from the position of the second contact section in the direction of elasticity.

In this case, it is preferable that when the direction of the elastic force acting on the first contact section from the first apparatus-side terminal is the direction of elasticity, the first contact section and the second contact section respectively which are to come in contact with the first apparatus-side terminal and the second apparatus-side terminal disposed in one line are disposed such that the position of the first contact section and the position of the second contact section are different in the direction of elasticity. In such a configuration, the amount of the elastic force is different for each terminal due to the apparatus-side terminal coming in contact with the first terminal and the second terminal, and as a result, in the elastic force due to the apparatus-side terminal, the size of a component in a mounting direction of the container and the size of a component in a direction orthogonal to the mounting direction are different for each terminal. That is, elastic forces having values and directions which are not uniform are in state of acting on a plurality of positions of a circuit substrate in which the container-side terminal group is provided. Thus, it is possible to suppress a positional shift or wobbling of the circuit substrate and to stably provide the circuit substrate. Thus, it is possible to provide the liquid storage container that is capable of suppressing the contact failure between the container-side terminal and the apparatus-side terminal.

It is preferable that the apparatus-side terminal group has a third apparatus-side terminal, and the container-side terminal group has a third terminal including a third contact section that comes in contact with the third apparatus-side terminal. It is preferable that when an assembly of the contact sections to come in contact with terminals that are included in the apparatus-side terminal group and correspond of the apparatus-side terminal group is a contact section group, the first contact section and the third contact section are positioned on both sides of the contact section group, and positions of the first contact section and the third contact section are positioned farther in the direction of elasticity than the position of the second contact section. In this case, since all the values of the elastic forces acting on both ends of the contact section group are small, it is possible to stabilize both ends of the circuit substrate. Thus, it is possible to suppress the positional shift or wobbling of the circuit substrate and to stably provide the circuit substrate. Therefore, it is possible to provide the liquid storage container that is capable of suppressing the contact failure between the container-side terminal and the apparatus-side terminal.

It is preferable that the apparatus-side terminal group has a third apparatus-side terminal, the container-side terminal group has a third terminal including a third contact section that comes in contact with the third apparatus-side terminal. It is possible that when an assembly of the contact sections to come in contact with terminals that are included in the apparatus-side terminal group and correspond of the apparatus-side terminal group is a contact section group, the first contact section and the third contact section are positioned on both sides of the contact section group, and positions of the first contact section and the third contact section are positioned farther in a direction opposite to the direction of elasticity than the position of the second contact section. In this case, since the value of the elastic force acting on the center of the contact section group is small, it is possible to stabilize the center of the circuit substrate. Thus, it is possible to suppress the positional shift or wobbling of the circuit substrate and to stably provide the circuit substrate. Thus, it is possible to provide the liquid storage container that is capable of suppressing the contact failure between the container-side terminal and the apparatus-side terminal.

It is preferable that the position of the first contact section and the position of the third contact section are different in the direction of elasticity. In this case, since all of the values of the elastic forces acting on the first, second, and third contact sections are different, a biasing force having a random value acts on three positions of the circuit substrate. Thus, wobbling of the circuit substrate is reduced and it is possible to stably provide the circuit substrate. Thus, it is possible to provide the liquid storage container that is capable of suppressing the contact failure between the container-side terminal and the apparatus-side terminal.

It is preferable that the position of the first contact section and the position of the third contact section are the same in the direction of elasticity. In this case, the values of the elastic forces acting on both ends of the contact section group can be the same as each other. Thus, it is possible to provide the liquid storage container that is capable of suppressing rotation of the circuit substrate due to the elastic force from the apparatus-side terminal.

It is preferable that when the second contact section is positioned at the center of the contact section group and a direction in which a portion of the apparatus-side terminal group coming in contact with the contact section group is in a line and is an X direction, the contact section group is symmetrical with respect to a virtual line intersecting perpendicularly to the X direction through the second contact section. In this case, the elastic force acts symmetrically based on the center of the contact section group as a reference. Thus, it is possible to provide the liquid storage container that is capable of suppressing the rotation of the circuit substrate due to the elastic force from the apparatus-side terminal.

It is preferable that the liquid storage container further includes a regulating section that regulates the movement of a circuit substrate on which the container-side terminal group is provided, and the regulating section is positioned farther in the direction of elasticity than the circuit substrate. In this case, the circuit substrate can be supported by the regulating section and it is possible to further stably provide the circuit substrate. Thus, it is possible to provide the liquid storage container that is capable of suppressing the contact failure or wobbling.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink cartridge that is an example of a liquid storage container to which the invention is applied will be described with reference to the drawings. In the following embodiment, the invention is applied to the ink cartridge detachably mounted on a cartridge mounting section of an ink jet printer that is an example of the liquid ejecting apparatus, but the invention can be also applied to a liquid storage container detachably mounted on a liquid ejecting apparatus ejecting a liquid other than ink.

Figure 1:
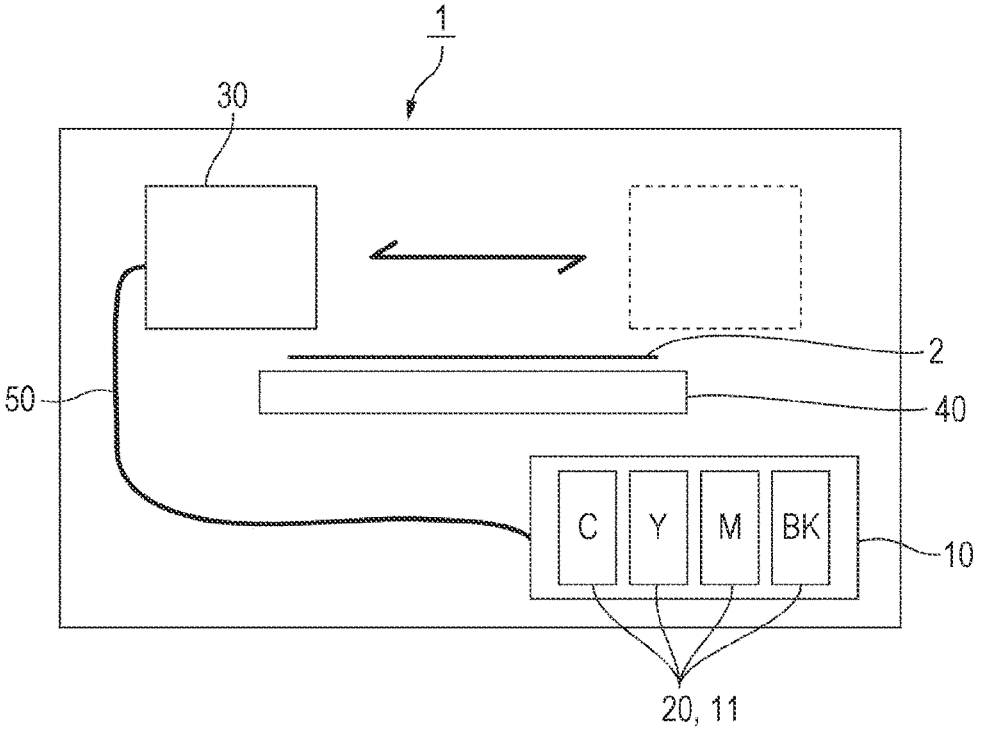
FIG. 1 is an explanatory view schematically illustrating a main portion of a printer including an ink cartridge to which an embodiment is applied.

FIG. 1 is an explanatory view schematically illustrating a main portion of the printer including the ink cartridge to which an embodiment is applied. A printer 1 (liquid ejecting apparatus) is the ink jet printer and performs printing by ejecting ink that is an example of the liquid onto a printing medium 2. The printer 1 includes a cartridge holder 10 on which ink cartridges 20 are detachably mounted, an ink jet head 30, a support member 40, a medium transport mechanism (not illustrated), a head moving mechanism (not illustrated), and the like. The printing medium 2 is transported by the medium transport mechanism including a sheet feeding roller and the like along a surface of the support member. The ink jet head 30 reciprocates through the head moving mechanism in a direction transverse the surface of the support member. When the printing medium 2 passes through the surface of the support member, the printing is performed by ejecting the ink from the ink jet head 30.

The cartridge holder 10 and the ink jet head 30 are connected by an ink supply tube 50. The cartridge holder 10 is provided with a plurality (for example, four) of cartridge mounting sections 11. The ink cartridges 20 storing cyan ink C, magenta ink M, yellow ink Y, and black ink Bk can be respectively mounted on four cartridge mounting sections 11. If the ink cartridge 20 is mounted on the cartridge mounting section 11, the ink in the ink cartridge 20 is supplied to the ink jet head 30 via the ink supply tube 50. Moreover, the number of the cartridge mounting sections 11 may be different from the number described above and the type of the ink may be different from the type described above. Furthermore, the ink jet printer 1 in the embodiment is an off-cartridge type in which the ink cartridge 20 (or the cartridge mounting section 11) is not moved while the ink jet head 30 reciprocates, but may be an on-cartridge type ink jet printer in which the ink cartridge 20 (or the cartridge mounting section 11) can be moved while the ink jet head 30 reciprocates.

First Embodiment

Ink Cartridge

Figure 2A:
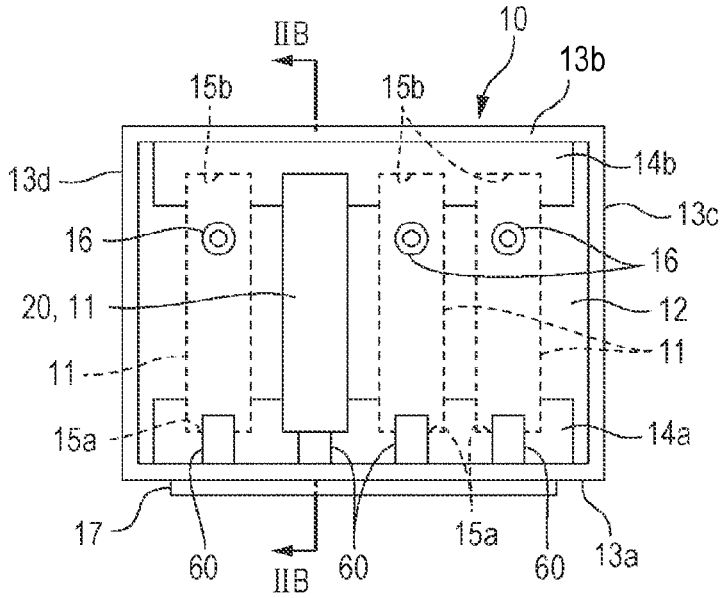
FIGS. 2A and 2B are respectively a plan view and a cross-sectional view schematically illustrating a cartridge holder and an ink cartridge of a first embodiment.
Figure 2B:
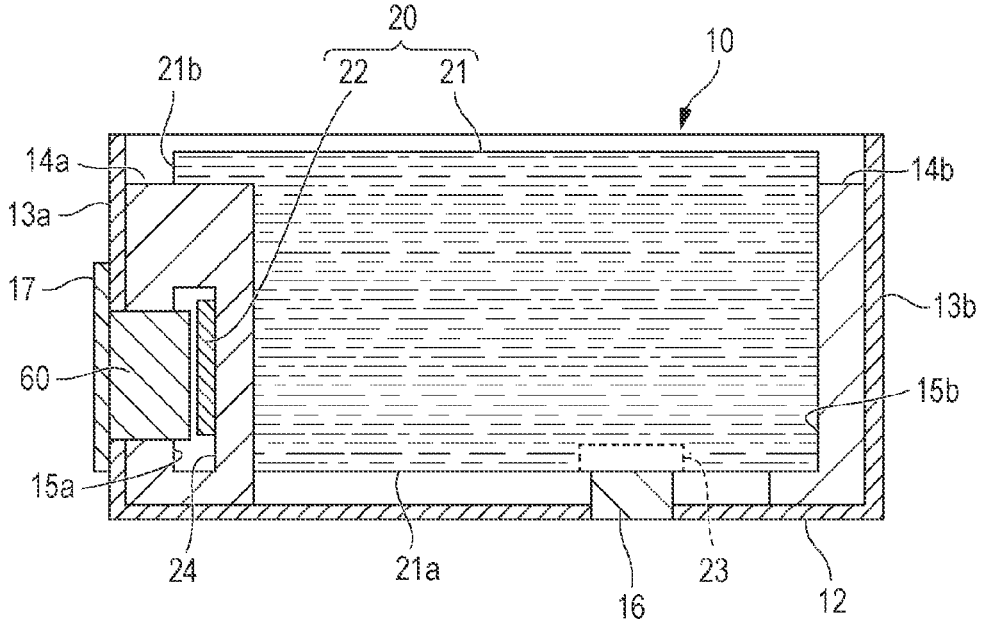

A first embodiment is a form in which a circuit substrate (container-side circuit substrate 22 described below) parallel to a mounting direction is mounted on a side surface of the ink cartridge 20. FIGS. 2A and 2B are respectively a plan view and a cross-sectional view schematically illustrating the ink cartridge 20 and the cartridge holder 10 of the first embodiment. FIG. 2A is a plan view of the cartridge holder 10 viewed from above and FIG. 2B is a cross-sectional view that is taken along line IIB-IIB of FIG. 2A. FIG. 2A illustrates a state where only one ink cartridge 20 is mounted on four cartridge mounting sections 11 provided in the cartridge holder 10. The cartridge holder 10 has a box shape and includes a rectangular bottom portion 12, a front portion 13*a* and a rear portion 13*b* standing upward from two sides facing each other of the bottom portion 12, and side portions 13*c* and 13*d* standing upward from the other two sides facing each other. Four cartridge mounting sections 11 are provided in one line in a direction in which the side portions 13*c* and 13*d* face each other inside of the cartridge holder 10.

The cartridge holder 10 is provided with a cartridge holding member 14*a* inside of the front portion 13*a*. Furthermore, a cartridge holding member 14*b* is provided on inside of the rear portion 13*b*. Four concave sections 15*a* are formed in the cartridge holding member 14*a* and four concave sections 15*b* are formed in the cartridge holding member 14*b*. The concave section 15*a* faces the concave section 15*b*. Tube connecting sections 16 are disposed one by one between four sets of the concave sections 15*a* and the concave sections 15*b* in the bottom portion 12 of the cartridge holder 10. The tube connecting section 16 is connected to the ink supply tube 50 from the rear side of the bottom portion 12. Furthermore, terminal modules 60 are disposed one by one in the concave sections 15*a* of the cartridge holding member 14*a*. An apparatus-side circuit substrate 17 is mounted on a region overlapping four terminal modules 60 outside the front portion 13*a*. The cartridge mounting section 11 includes a pair of the concave sections 15*a* and 15*b* facing each other, the tube connecting section 16, and the terminal module 60.

As illustrated in FIG. 2B, the ink cartridge 20 includes a container body 21 for storing ink and the container-side circuit substrate 22. The container body 21 has a box shape and if the bottom portion 21*a* is considered a first surface, the container body 21 is constituted by the first surface, a second surface that is an upper portion facing the first surface, a third surface that is a side portion 21*b* intersecting the first surface and the second surface, a fourth surface that faces the third surface, a fifth surface that intersects the first surface to fourth surface, and a sixth surface that faces the fifth surface. An ink supply section 23 capable of supplying ink stored inside the container body 21 to the outside of the container body 21 is formed on the first surface that is a bottom portion 21*a*. Moreover, in the embodiment, ink is stored inside the container body 21, but the container body 21 may be in a state of housing a bag storing ink. Furthermore, the container body 21 is constituted by the first surface to sixth surface, but the invention is not limited to such an embodiment. The container-side circuit substrate 22 is mounted on a concave section 24 formed on the third surface that is the side portion 21*b* of one end side of the container body 21. The ink cartridge 20 is mounted in a direction (direction in which gravity acts)

perpendicular to the bottom portion 12 of the cartridge holder 10. When this direction is a mounting direction, the container-side circuit substrate 22 is disposed on the third surface so as to be parallel to the mounting direction of the ink cartridge 20. When the ink cartridge 20 is mounted on the cartridge mounting section 11, one end and the other end of the container body 21 are inserted into the concave sections 15*a* and 15*b*, and an ink supply needle provided in the tube connecting section 16 of the cartridge mounting section 11 is inserted into the ink supply section 23 of the container body 21. Furthermore, as described below, an apparatus-side terminal 62 (see FIG. 3) provided in the terminal module 60 of the cartridge mounting section 11 comes in contact with a container-side terminal 25 (see FIG. 3) provided in the container-side circuit substrate 22 in a contact portion that is a part of the container-side terminal 25.

Contact State between Container-side Terminal and Apparatus-side Terminal

Figure 3:
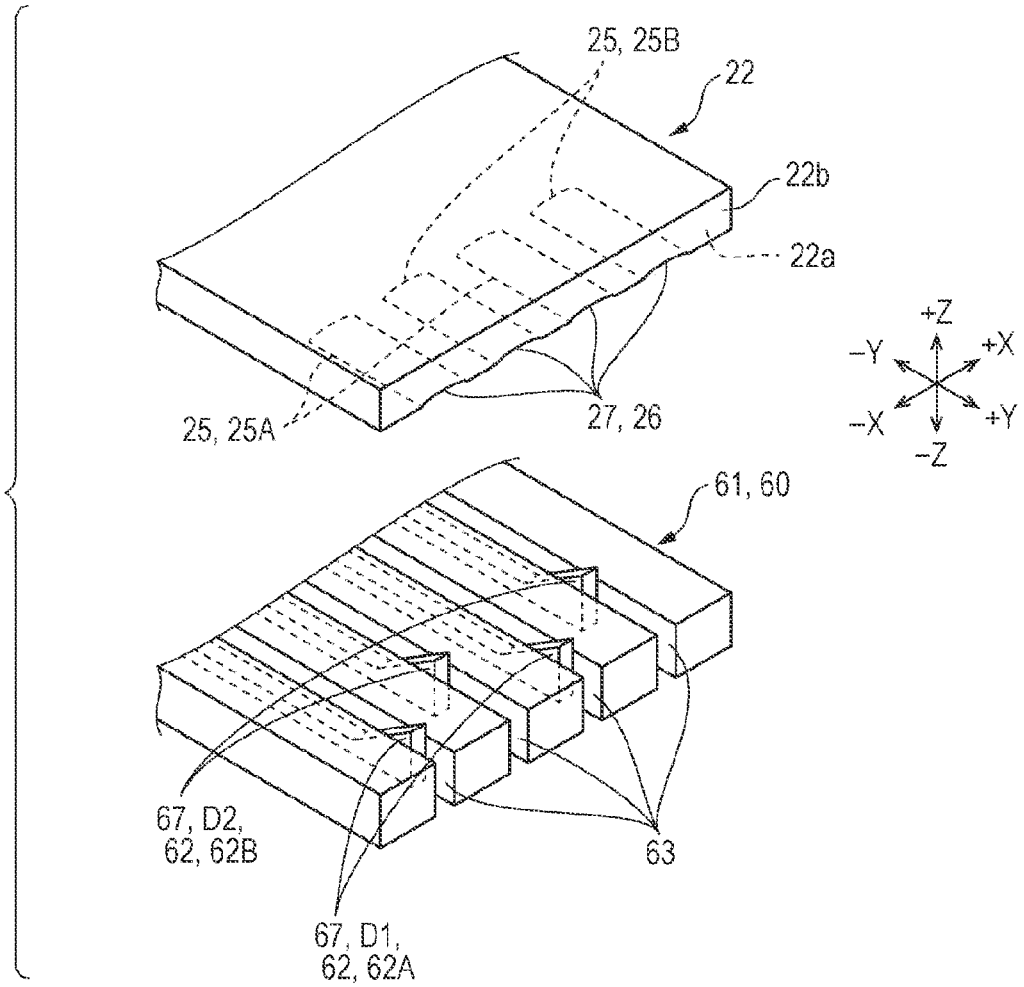
FIG. 3 is a partial perspective view schematically illustrating a main portion of a terminal module and a container-side circuit substrate of the first embodiment.
Figure 4:
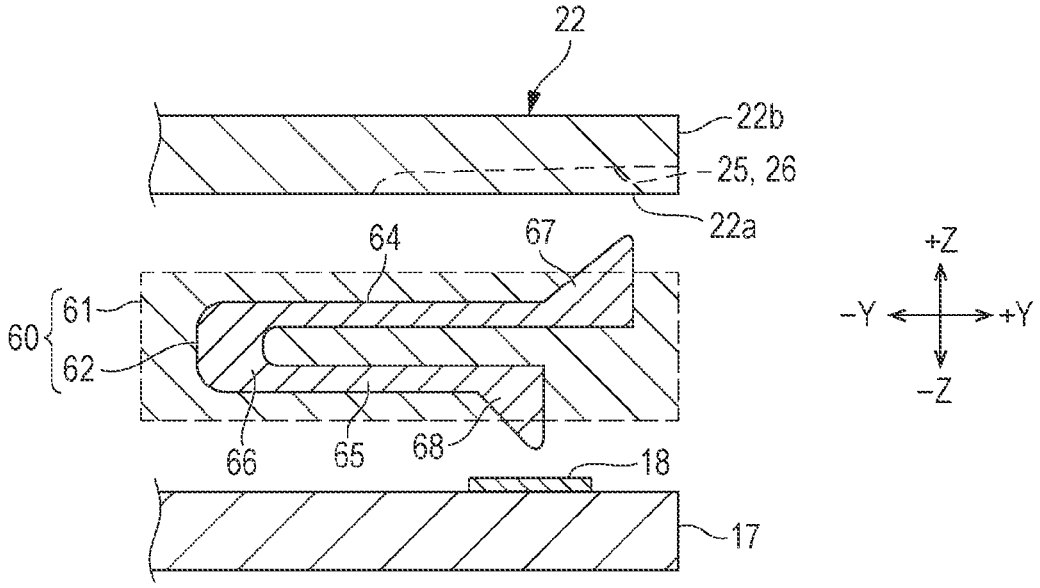
FIG. 4 is an exploded view schematically illustrating an apparatus-side circuit substrate, the terminal module, and the container-side circuit substrate of the first embodiment.

FIG. 3 is a partial perspective view schematically illustrating a main portion of the terminal module 60 and the container-side circuit substrate 22. FIG. 4 is an exploded view schematically illustrating the apparatus-side circuit substrate 17, the terminal module 60, and the container-side circuit substrate 22. Hereinafter, in the first embodiment, three directions orthogonal to each other are referred to as an X-axis direction, a Y-axis direction, and a Z-axis direction. Furthermore, one side of the X-axis direction is a +X direction, and the other side of the X-axis direction is a −X direction. One side of the Y-axis direction is a +Y direction, and the other side of the Y-axis direction is a −Y direction. One side of the Z-axis direction is a +Z direction, and the other side of the Z-axis direction is a −Z direction.

Even though a portion thereof is omitted in FIG. 3, the shape of the container-side circuit substrate 22 is substantially a rectangular parallelepiped (box shape) similar to the container body 21 of the ink cartridge 20 and is constituted by six surfaces. As illustrated in FIG. 3, a plurality of container-side terminals 25 are formed in at least a first surface of the six surfaces in the X-axis direction. That is, when a surface facing the first surface of the container-side circuit substrate 22 is a second surface, a surface intersecting the first surface and the second surface is a third surface, a surface facing the third surface is a fourth surface, a surface intersecting the first to fourth surfaces is a fifth surface, and a surface facing the fifth surface is a sixth surface, the plurality of container-side terminals 25 are formed in a direction in which the third surface and the fourth surface face. In the embodiment, the container-side circuit substrate 22 is mounted on the third surface that is the side portion 21*b* of the ink cartridge 20 in a posture in which the first surface that is a substrate surface 22*a* in which the container-side terminal 25 is provided faces a side (−Z direction side) of the terminal module 60. The container-side terminal 25 is formed inside a groove 26 formed at least on the substrate surface 22*a* of the container-side circuit substrate 22, and is formed of a conductive layer of copper and the like. A plurality of grooves 26 are recessed in a direction from the first surface to the second surface, extend in the Y-axis direction (direction in which the fifth surface and the sixth surface face each other) in the substrate surface 22*a*, and are formed in a line in the X-axis direction (direction in which the third surface and the fourth surface face each other). As described above, the container-side circuit substrate 22 faces the +Y direction (direction from the side surface to the fifth surface) and includes the fifth surface that is a substrate end surface 22*b* intersecting the substrate surface 22*a* (first surface). The groove 26 is formed in a corner portion in which the first surface that is the substrate surface 22*a* comes in contact (intersect) with the fifth surface that is the substrate end surface 22*b* along the Y direction (direction in which the fifth surface and the side surface face each other), and a curved edge portion 27 is formed at the corner portion.

The terminal module 60 includes housing 61 and a plurality of apparatus-side terminals 62. A plurality of slits 63 extending in Y-axis direction are formed in the housing 61. The plurality of slits 63 are formed in a line in the X-axis direction. That is, in order to simplify the drawing, only four container-side terminals 25 and the slits 63 are respectively illustrated in FIG. 3, but the number thereof may be four or greater. One apparatus-side terminal 62 is mounted on each slit 63. The apparatus-side terminal 62 is formed of a thin plate of metal. As illustrated in FIG. 4, the apparatus-side terminal 62 includes a first arm 64 and a second arm 65 extending in the Y-axis direction, a curved connection section 66 that connects end portions of the first arm 64 and the second arm 65, a substantially triangular first protrusion section 67 that is provided at a leading end of the first arm 64, and a substantially triangular second protrusion section 68 that is provided at a leading end of the second arm 65.

As illustrated in FIG. 3, the first arm 64 and the first protrusion section 67 are inserted into the slit 63 of the housing 61. The first protrusion section 67 protrudes from the slit 63 to a side (+Z direction side) of the container-side circuit substrate 22. Meanwhile, the second protrusion section 68 provided at the leading end of the second arm 65 protrudes from the housing 61 to a side (−Z direction side) of the apparatus-side circuit substrate 17 (see FIG. 4). The second protrusion section 68 of the terminal module 60 comes in contact with a terminal 18 of the apparatus-side circuit substrate 17 through a penetrating section provided in the front portion 13*a* of the cartridge holder 10. The first arm 64 and the second arm 65 elastically swing in the Z-axis direction about the connection section 66 engaged with the housing 61 as a fulcrum. Thus, the second protrusion section 68 elastically comes in contact with the terminal 18 of the apparatus-side circuit substrate 17. Furthermore, when the ink cartridge 20 is mounted on the cartridge mounting section 11, the first protrusion section 67 elastically comes in contact with the contact section included in the container-side terminal 25 of the container-side circuit substrate 22. That is, in a state where the first protrusion section 67 comes in contact with the contact section of the container-side terminal 25, the first protrusion section 67 applies an elastic force to the contact section included in the container-side terminal 25. When the ink cartridge 20 is mounted on the cartridge holder 10, the container-side circuit substrate 22 moves relative to the terminal module 60 in the Y-axis direction and is inserted at a position in which the apparatus-side terminal 62 can come into contact with the contact section of the container-side terminal 25.

As illustrated in FIG. 3, the first protrusion sections 67 of the apparatus-side terminal 62 are disposed such that a plurality of lines are formed in a first position D1 in the slit 63 and a second position D2 that is a position on the −Y direction side farther than the first position D1. Furthermore, the first protrusion sections 67 are alternately disposed in the first position D1 and the second position D2 along an arrangement direction (that is, the X-axis direction) of the slits 63. Hereinafter, the plurality of apparatus-side terminals 62 in which the first protrusion sections 67 are disposed in the first position D1 are referred to as a first apparatus-side terminal group 62A (apparatus-side terminal group). The plurality of apparatus-side terminals 62 in which the first protrusion sections 67 are disposed in the second position D2 are referred to as a second apparatus-side terminal group 62B. That is, the apparatus-side terminal 62 is constituted by the first apparatus-side terminal group 62A forming one line and the second apparatus-side terminal group 62B forming one line. The first protrusion section 67 is positioned in the direction in which gravity acts of the terminal module 60 and when viewing the terminal module 60 in which the direction of the first protrusion section 67 is toward a front side, the first apparatus-side terminal group 62A and the second apparatus-side terminal group 62B are formed so as to be aligned in the direction (vertical direction) in which gravity acts. The first apparatus-side terminal group 62A is positioned on a side (lower side in the vertical direction) in the direction in which gravity acts farther than the second apparatus-side terminal group 62B. Furthermore, the container-side terminals 25 in which a plurality of contact sections that come in contact with the first apparatus-side terminal group 62A are formed are referred to as a first container-side terminal group 25A (container-side terminal group). The container-side terminals 25 in which a plurality of contact sections to come in contact with the second apparatus-side terminal group 62B are formed are referred to as a second container-side terminal group 25B. Moreover, the contact section is a part of the container-side terminal 25 that comes in contact (presupposed or planed to come into contact) with the first apparatus-side terminal group 62A or the second apparatus-side terminal group 62B in a state where the ink cartridge 20 is mounted on the cartridge mounting section 11 and the printer 1 (or the apparatus-side circuit substrate 17) and the ink cartridge 20 (or the container-side circuit substrate 22) are electrically connected. Furthermore, the contact state is referred to as a state where the first apparatus-side terminal group 62A or the second apparatus-side terminal group 62B comes in contact with the contact section.

Figure 5A:
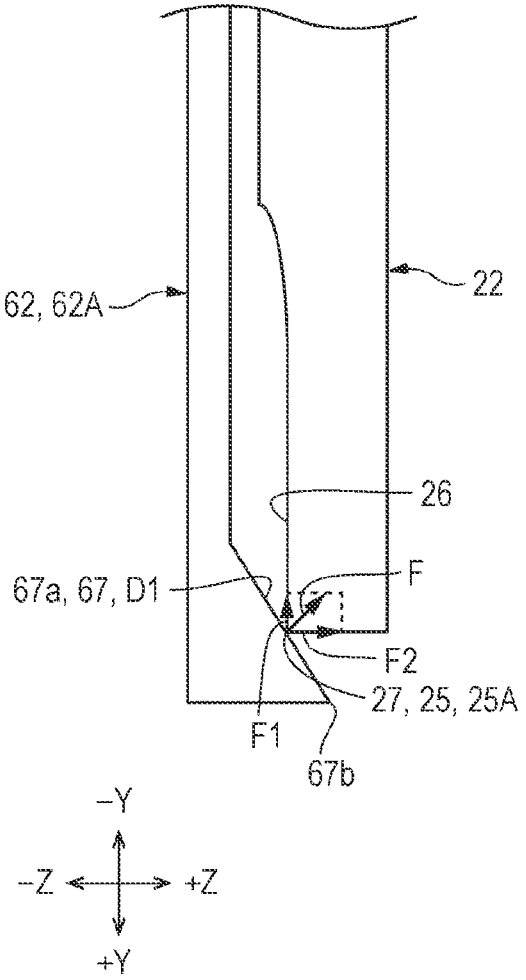
FIGS. 5A and 5B are explanatory views illustrating a contact state between an apparatus-side terminal and a container-side terminal of the first embodiment.
Figure 5B:
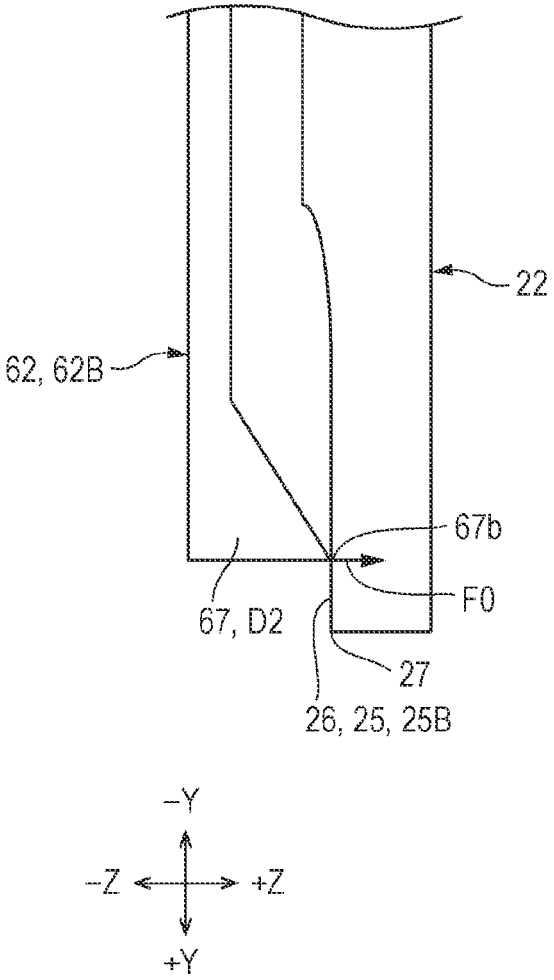

FIGS. 5A and 5B are explanatory views illustrating a contact state between the apparatus-side terminal 62 and the container-side terminal 25. FIG. 5A illustrates a contact state between the first apparatus-side terminal group 62A and the first container-side terminal group 25A. FIG. 5B illustrates a contact state between the second apparatus-side terminal group 62B and the second container-side terminal group 25B. As described above, the container-side terminal 25 includes the curved edge portion 27 (refer to FIG. 3) formed in the corner portion (intersecting portion) in which the substrate surface 22*a* (first surface) and the substrate end surface 22*b* (fifth surface) are connected. When the ink cartridge 20 is mounted on the cartridge mounting section 11 and is in the contact state, as illustrated in FIG. 5A, the first protrusion section 67 of the apparatus-side terminal 62 disposed in the first position D1 comes in contact with the contact section in which an inclined section 67*a* is at the edge portion 27 of the container-side terminal 25. Furthermore, as illustrated in FIG. 5B, the apparatus-side terminal 62 disposed in the second position D2 comes in contact with the contact section in which a leading end portion 67*b* of the first protrusion section 67 is formed inside (first surface) of the groove 26. As described above, if the first apparatus-side terminal group 62A comes in contact with the contact section of the container-side terminal 25 using the edge portion 27 of the container-side terminal 25 and the second apparatus-side terminal group 62B comes in contact with the contact section of the container-side terminal 25 inside the groove 26, the container-side terminal 25 may be disposed only in one line in the substrate surface 22*a*. Thus, the container-side terminals 25 can come into contact with the apparatus-side terminals 62 disposed in two lines while reducing the area of the substrate surface 22*a* (first surface) by reducing the installation space of the container-side terminals 25.

Here, as described above, since the apparatus-side terminal 62 has elasticity, the container-side circuit substrate 22 is biased by the elastic force acting on the contact section in which the container-side terminal 25 comes in contact with the apparatus-side terminal 62. As illustrated in FIG. 5A, the direction of an elastic force F acting on the contact section by contacting with the apparatus-side terminal 62 of the first apparatus-side terminal group 62A is an inclined direction (intersecting direction) with respect to +Z direction (direction from the first surface to the second surface of the substrate). Furthermore, as illustrated in FIG. 5B, the direction of an elastic force F0 acting on the contact section by contacting with the apparatus-side terminal 62 of the second apparatus-side terminal group 62B is the +Z direction (direction from the first surface to the second surface). That is, the direction of the elastic force F acting on the contact section by contacting with the apparatus-side terminal 62 of the first apparatus-side terminal group 62A and the direction of the elastic force F0 acting on the contact section by contacting with the apparatus-side terminal 62 of the second apparatus-side terminal group 62B are different.

Shape of Container-side Terminal

Figure 6A:
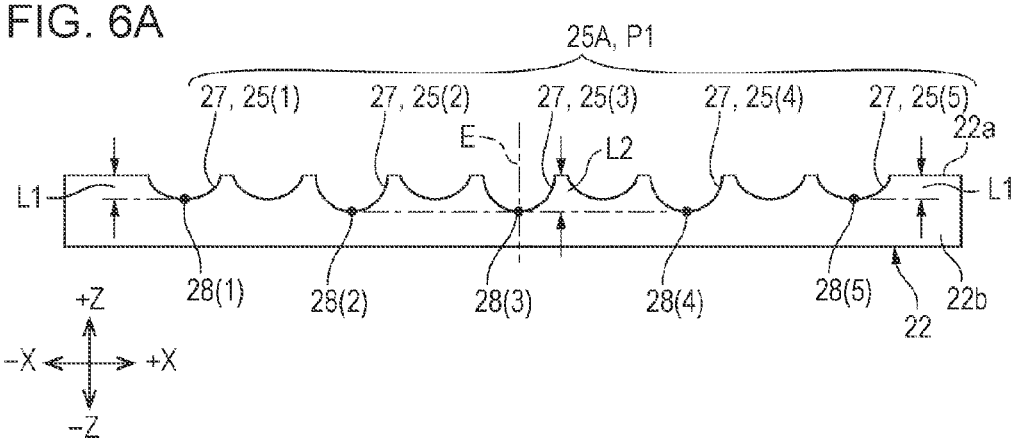
FIGS. 6A to 6C are side views of an end surface of the substrate in which edge portions of the container-side terminals of the first embodiment are formed.
Figure 6B:
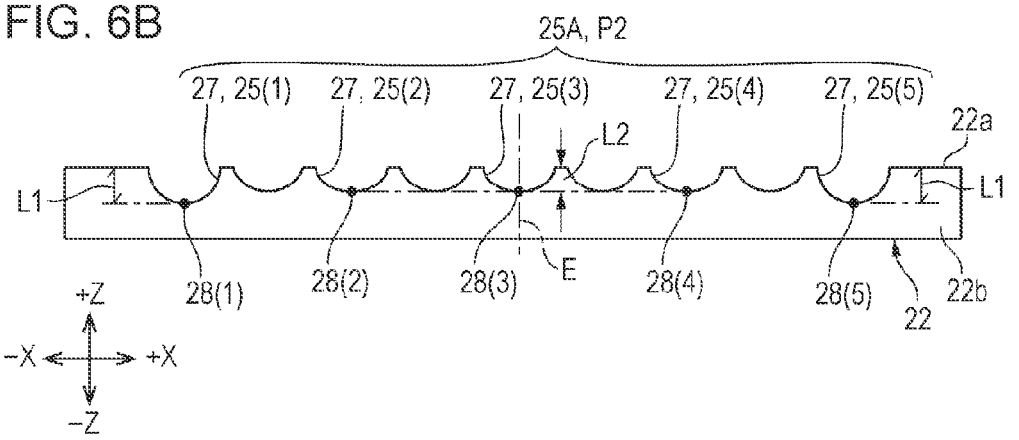
Figure 6C:
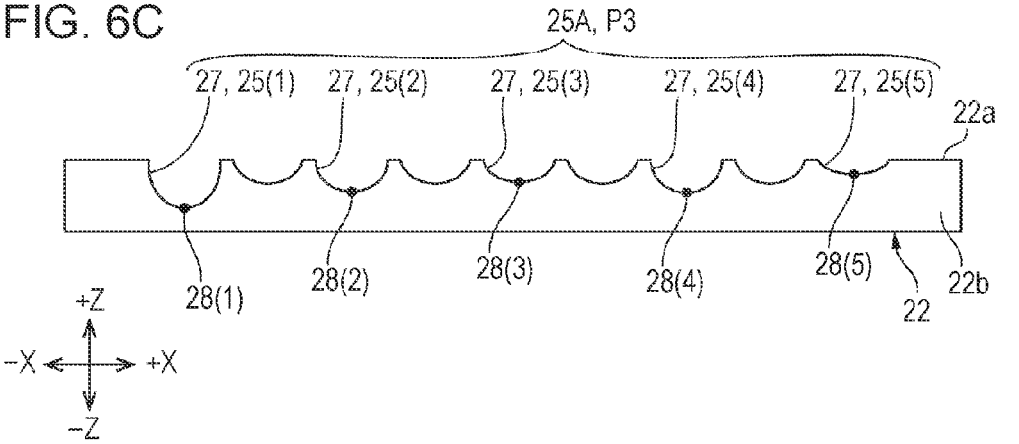
Figure 7A:
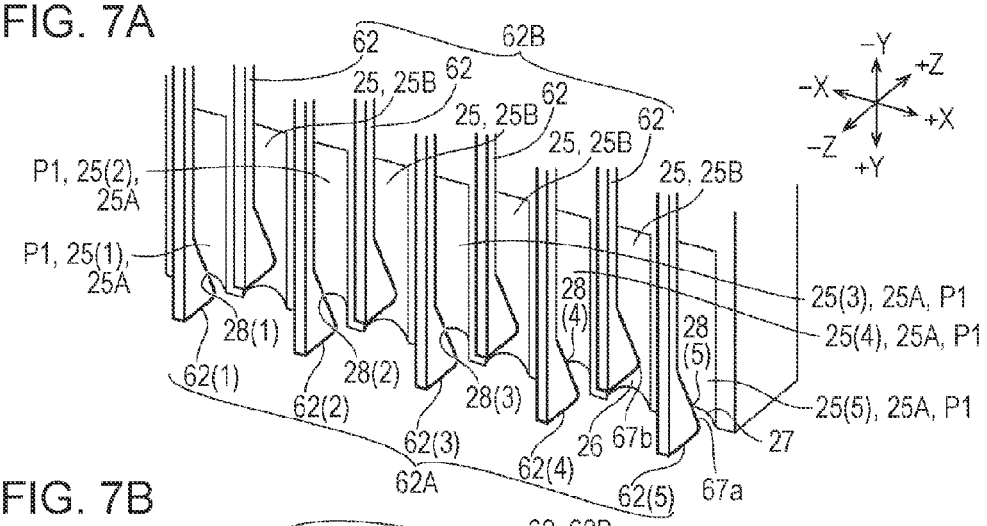
FIGS. 7A to 7C are perspective views of the container-side terminals and the apparatus-side terminals of the first embodiment.
Figure 7B:
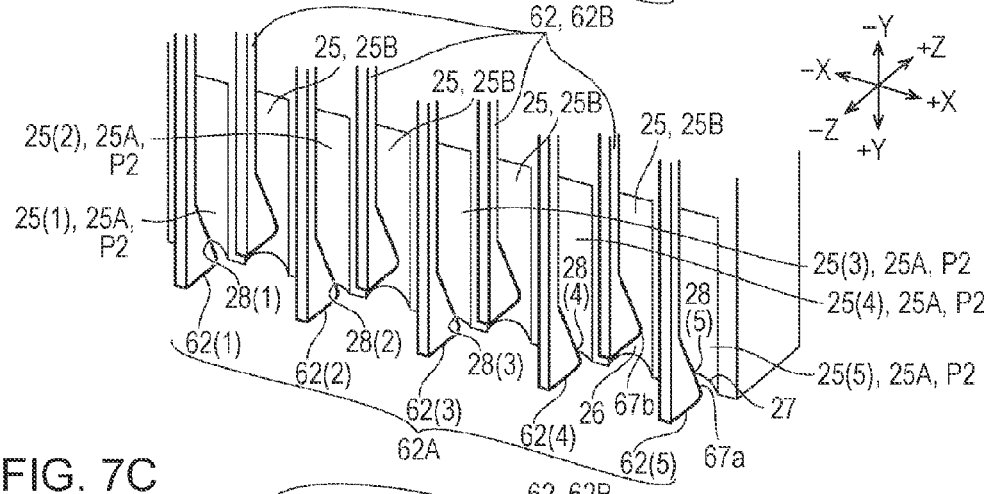
Figure 7C:
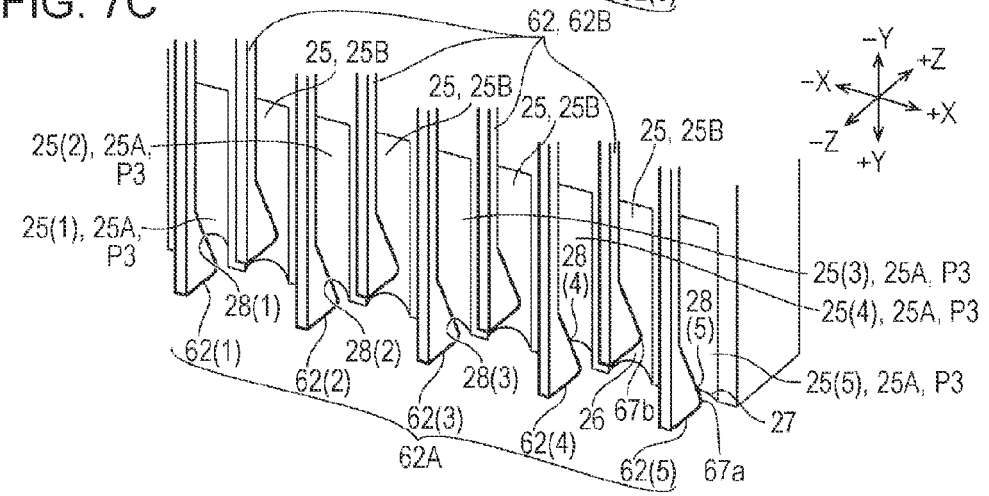

FIGS. 6A to 6C and FIGS. 7A to 7C are explanatory views illustrating the shape of each terminal included in the first container-side terminal group 25A, and FIGS. 6A to 6C are side views of the substrate end surface 22*b* (fifth surface) in which the edge portion 27 of the container-side terminal 25 is formed. Furthermore, FIGS. 7A to 7C are perspective views of the container-side terminal 25 and the apparatus-side terminal 62. As described above, the first container-side terminal group 25A and the second container-side terminal group 25B are alternately formed in the X-axis direction (direction in which the third surface and the fourth surface face each other) in the substrate surface 22*a* (first surface) of the container-side circuit substrate 22. In FIGS. 6A to 6C and FIGS. 7A to 7C, the plurality of apparatus-side terminals 62 included in the first apparatus-side terminal group 62A are referred to as an apparatus-side terminal 62(1) (first apparatus-side terminal), an apparatus-side terminal 62(2), an apparatus-side terminal 62(3) (second apparatus-side terminal), an apparatus-side terminal 62(4), and an apparatus-side terminal 62(5) (third apparatus-side terminal) in the disposal order from the −X-axis direction to the +X-axis direction. Furthermore, the container-side terminals 25 of the first container-side terminal group 25A in which contact sections that come in contact therewith and are respectively formed are referred to as a container-side terminal 25(1) (first container-side terminal), a container-side terminal 25(2), a container-side terminal 25(3) (second container-side terminal), a container-side terminal 25(4), and a container-side terminal 25(5) (third container-side terminal) in the disposal order from the −X-axis direction to the +X-axis direction. The container-side terminals 25(1) to 25(5) include the grooves 26 having different depths. The difference in the depths of the grooves 26 means that the positions in a direction from the first surface to the second surface of the edge portions 27 (contact sections) in which the first surface intersects the fifth surface of the container-side circuit substrate 22 are different. Furthermore, as described below, when the direction of the elastic force acting on the contact section of the container-side terminal 25(1) (first container-side terminal) from the apparatus-side terminal 62(1) (first apparatus-side terminal) is the direction of elasticity, it is also possible to express that the positions of the edge portions 27 (contact sections) are different in the direction of elasticity.

FIGS. 6A to 6C and FIGS. 7A to 7C illustrate shapes of terminals of three patterns in which the depths at which the grooves 26 are formed are different. FIGS. 6A and 7A illustrate a shape in which a depth L1 of the grooves 26 of the container-side terminal 25(1) and the container-side terminal 25(5) of the first container-side terminal group 25A, which are positioned at both ends (both ends in the disposing direction), is shallower than a depth L2 of the grooves 26 of the container-side terminals 25(2) to 25(4) positioned therebetween. That is, the edge portions 27 of the container-side terminal 25(1) and the container-side terminal 25(5) of the first container-side terminal group 25A, which are positioned at both ends of the first container-side terminal group 25A, have a shape so as to be positioned on the first surface side farther than the edge portions 27 of the container-side terminals 25(2) to 25(4) positioned therebetween in a direction from the first surface to the second surface. Furthermore, FIGS. 6B and 7B illustrate a shape in which the depth L1 of the grooves 26 of the container-side terminals 25(1) and 25(5) positioned at both ends is deeper than the depth L2 of the grooves 26 of the container-side terminals 25(2) to 25(4) positioned therebetween. That is, the edge portions 27 of the container-side terminals 25(1) and 25(5) positioned at both ends have a shape so as to be positioned on the second surface side farther than the edge portions of the container-side terminals 25(2) to 25(4) positioned therebetween in the direction from the first surface to the second surface. Then, FIGS. 6C and 7C illustrate shapes in which the depths of the grooves 26 of the container-side terminals 25(1) to 25(5) are randomly set. That is, the edge portions of the container-side terminals 25(1) to 25(5) have a shape which is randomly set in the direction from the first surface to the second surface. Hereinafter, the shape of FIGS. 6A and 7A is referred to as a first shape P1, the shape of FIGS. 6B and 7B is referred to as a second shape P2, and the shape of FIGS. 6C and 7C is referred to as a third shape P3.

In the container-side terminal 25 of the first container-side terminal group 25A, the center (that is, a position where the depth of the groove 26 is the deepest) of the edge portion 27 in the X-axis direction is a contact section 28 that comes in contact with the inclined section 67*a* of the apparatus-side terminal 62. Hereinafter, contact sections that are portions that come in contact with the inclined sections 67*a* in the container-side terminals 25(1) to 25(5) are respectively referred to as a contact section 28(1) (first contact section), a contact section 28(2), a contact section 28(3) (second contact section), a contact section 28(4), and a contact section 28(5) (third contact section). The container-side terminals 25 include a contact section group having the contact sections 28(1) to 28(5) in five positions. In the first shape P1 illustrated in FIGS. 6A and 7A, and in the second shape P2 illustrated in FIGS. 6B and 7B, the depths (positions of the edge portions 27 in the direction in which the first surface faces the second surface) of the grooves 26 in the container-side terminals 25(1) and 25(5), and in the container-side terminals 25(2) to 25(4) are different. Thus, the positions of the contact sections 28(1) and 28(5), and of the contact sections 28(2) to 28(4) are different in the Z-axis direction (direction in which the first surface faces the second surface). That is, when the direction of the elastic force acting on the contact section 28(1) is the direction of elasticity, the position of the contact section 28(5) in the direction of elasticity is the same as the position of the contact section 28(1) and the positions of the contact sections 28(2) to 28(4) are different from the position of the contact section 28(1).

As illustrated in FIG. 5A, the elastic force F acting on the container-side terminal 25 of the first container-side terminal group 25A from the apparatus-side terminal 62 of the first apparatus-side terminal group 62A acts in the inclined direction with respect to the Z-axis direction (direction in which the first surface faces the second surface) and includes a component force F1 in the Y-axis direction (direction in which the fifth surface faces the sixth surface) and a component force F2 in the Z-axis direction. In the first shape P1 and the second shape P2, if depths of the grooves 26 in the container-side terminals 25(1) and 25(5), and the container-side terminals 25(2) to 25(4) are different, the positions of the contact section 28(1) and the contact section 28(5), and the positions of the contact sections 28(2) to 28(4) are different in an inclined direction with respect to the direction in which the first surface faces the second surface. That is, when the direction of the elastic force acting on the contact section 28(1) is the direction of elasticity, the position of the contact section 28(5) is the same as the position of the contact section 28(1) in the direction of elasticity and the positions of the contact sections 28(2) to 28(4) are different from the position of the contact section 28(1). As a result, in the contact section 28(1) and the contact section 28(5), and the contact sections 28(2) to 28(4), the direction or the value of the acting elastic force F is different and values of the component force F1 in the Y-axis direction and the component force F2 in the Z-axis direction are different. Furthermore, in the third shape P3, since the depths of the grooves 26 are random, the direction or the value of the elastic force F acting on the contact sections 28(1) to 28(5) is random. That is, when the direction of the elastic force acting on the contact section 28(1) is the direction of elasticity, the positions of the contact sections 28(2) to 28(5) are all random in the direction of elasticity. For example, as illustrated in FIGS. 6C and 7C, if the depths of the grooves 26 in the container-side terminals 25(1) to 25(5) are all different, the elastic forces F acting on the contact sections 28(1) to 28(5) are all different in the direction and the value thereof. That is, the positions of the contact sections 28(1) to 28(5) are all different in the direction of elasticity.

As described above, in each of the first shape P1, the second shape P2, and the third shape P3, the first container-side terminal group 25A includes the container-side terminals 25 in which depths of the grooves 26 are different. In this case, the first container-side terminal group 25A includes the contact sections 28 (for example, the contact section 28(1) and the contact section 28(3)) of which the positions are different in the direction in which the first surface faces the second surface. That is, when the direction of the elastic force acting on the contact section 28(1) is the direction of elasticity, the contact section 28 (for example, the contact section 28(3)) different in the position of the contact section 28(1) in the direction of elasticity is included. As a result, the elastic forces F having different sizes and directions act on the container-side circuit substrate 22 at different positions. As described above, in a state where the elastic forces F having the values and the directions which are not uniform act on a plurality of positions of the container-side circuit substrate 22, it is possible to suppress a concern that the positional shift or wobbling of the container-side circuit substrate 22 occurs compared to a case where the elastic forces F having the values and the directions which are uniform act. Thus, it is possible to stably provide the container-side circuit substrate 22 and it is possible to suppress the contact failure between the container-side terminal 25 and the apparatus-side terminal 62.

Furthermore, if an acting direction of the elastic force coincides with the mounting direction of the container-side circuit substrate 22 on the ink cartridge 20, there is a concern that the positional shift of the container-side circuit substrate 22 will occur due to the elastic force. However, in the embodiment, the elastic force F acts obliquely in the mounting direction (in the embodiment, the Y-axis direction or the direction in which the sixth surface faces the fifth surface) of the container-side circuit substrate 22 and includes the component force F1 in the Y-axis direction coinciding with the mounting direction, but also includes the component force F2 in the Z-axis direction orthogonal to the mounting direction. Thus, it is possible to suppress the positional shift of the container-side circuit substrate 22 in the mounting direction (Y-axis direction) of the container-side circuit substrate 22. Furthermore, it is possible to suppress the inclination of the container-side circuit substrate 22. Thus, it is possible to stably dispose the container-side circuit substrate 22 and it is possible to suppress the contact failure between the container-side terminal 25 and the apparatus-side terminal 62.

Furthermore, in the first shape P1 and the second shape P2, the contact sections 28(1) to 28(5) in the container-side terminal 25 are disposed so as to be symmetrical about a virtual line E as an axis extending in the Y-axis direction (direction which intersects perpendicularly to the disposing direction and in which the first surface faces the second surface) through the contact section 28(3) positioned at the center in the X-axis direction (direction in which the third surface faces the fourth surface) that is the disposal direction. Thus, the elastic forces F having the same value from the apparatus-side terminal 62 act symmetrically about the virtual line E as the axis. Thus, it is possible to suppress rotation of the container-side circuit substrate 22 due to the elastic force F.

Here, in the first shape P1, the depth L1 of the grooves 26 is the same in the container-side terminal 25(1) and the container-side terminal 25(5) positioned at both ends in the disposal direction of the first container-side terminal group 25A, and the depth L1 of the grooves 26 at both ends is shallower than the depth L2 of the grooves 26 of three container-side terminals 25(2) to 25(4) positioned between the container-side terminal 25(1) and the container-side terminal 25(5). That is, the positions (positions of contact sections) of the edge portions 27 of the container-side terminal 25(1) and the container-side terminal 25(5) of the first container-side terminal group 25A, which are positioned at both ends in the direction in which the third surface faces the fourth surface, are the same in the direction in which the first surface faces the second surface, and are positioned on the side of the direction from the second surface to the first surface farther than the positions of the edge portions 27 (contact sections) of three container-side terminals 25(2) to 25(4) positioned between the container-side terminal 25(1) and the container-side terminal 25(5). That is, when the direction of the elastic force acting on the contact section 28(1) is the direction of elasticity, the position of the contact section 28(5) in the direction of elasticity is the same as the position of the contact section 28(1) and the contact sections 28(2) to 28(4) are positioned on the direction of elasticity side farther than the contact section 28(1). Thus, the elastic force F acting on the contact sections 28(2) to 28(4) therebetween is smaller than the elastic force F acting on the contact sections 28(1) and 28(5) positioned at both ends of the container-side circuit substrate 22.

As described above, in the first shape P1, the elastic force which is smaller than the elastic force acting on the contact sections of both ends acts on the contact section of the center of the container-side circuit substrate 22 and it is possible to stably hold the center portion of the container-side circuit substrate 22. Thus, it is possible to suppress the wobbling of the container-side circuit substrate 22. Thus, it is possible to suppress the contact failure between the container-side terminal 25 and the apparatus-side terminal 62. Moreover, in the first shape P1, the depths of the grooves 26 of the container-side terminal 25(1) and the container-side terminal 25(5) may not be the same and the depths of the grooves 26 in the container-side terminals 25(2) to 25(4) may not be the same. Also in this case, similar advantages can be obtained. That is, if the depths of the grooves 26 of two the container-side terminals 25(1) and 25(5) disposed at both ends are greater than the depths of the grooves 26 of the container-side terminals 25(2) to 25(4) disposed therebetween, similar advantages can be obtained.

Meanwhile, in the second shape P2, the depth L1 of the grooves 26 in the container-side terminal 25(1) and the container-side terminal 25(5) positioned at both ends in the disposal direction of the first container-side terminal group 25A is deeper than the depth L2 of the grooves 26 of three container-side terminals 25(2) to 25(4) positioned therebetween. That is, the positions (positions of contact sections) of the edge portions 27 of the container-side terminal 25(1) and the container-side terminal 25(5) of the first container-side terminal group 25A, which are positioned at both ends in the direction in which the third surface faces the fourth surface are same in the direction in which the first surface faces the second surface, and are positioned on the side of the direction from the first surface to the second surface farther than the positions of the edge portions 27 (contact sections) of three container-side terminals 25(2) to 25(4) positioned between the container-side terminal 25(1) and the container-side terminal 25(5). That is, when the direction of the elastic force acting on the contact section 28(1) is the direction of elasticity, the position of the contact section 28(5) in the direction of elasticity is the same as the position of the contact section 28(1) and the contact sections 28(2) to 28(4) are positioned on the direction opposite to the direction of elasticity farther than the contact section 28(1). Thus, the elastic force F acting on the contact sections 28(2) to 28(4) therebetween is greater than the elastic force F acting on the container-side terminals 28(1) and 28(5) positioned at both ends of the container-side circuit substrate 22.

As described above, in the second shape P2, the elastic force which is smaller than the elastic force acting on the contact section of the center acts on the contact sections of both ends of the container-side circuit substrate 22 and it is possible to stably hold both of the end portions of the container-side circuit substrate 22. Thus, it is possible to suppress the wobbling of the container-side circuit substrate 22. Thus, it is possible to suppress the contact failure between the container-side terminal 25 and the apparatus-side terminal 62. Moreover, also in the second shape P2, the depths of the grooves 26 of the container-side terminal 25(1) and the container-side terminal 25(5) may not be the same and the depths of the grooves 26 in the container-side terminals 25(2) to 25(4) may not be the same. Also in this case, similar advantages can be obtained. That is, if the depths of the grooves 26 of two the container-side terminals 25(1) and 25(5) disposed at both ends are smaller than the depths of the grooves 26 of the container-side terminals 25(2) to 25(4) disposed therebetween, similar advantages can be obtained.

Furthermore, in the third shape P3, the depths of the grooves 26 are random. That is, since positions (positions of the contact sections) of the edge portions 27 of the container-side terminals 25(1) to 25(5) are different in the direction in which the first surface faces the second surface, the values and the directions of the elastic forces F acting on the contact sections 28(1) to 28(5) are respectively different. That is, when the direction of the elastic force acting on the contact section 28(1) is the direction of elasticity, the positions of the contact sections 28(2) to 28(5) are all different in the direction of elasticity. In this case, the elastic forces F having different directions and values act on the plurality of positions in the container-side circuit substrate 22. Thus, it is possible to reduce the wobbling of the container-side circuit substrate 22 and to stably provide the container-side circuit substrate 22 unlike in a case where the sizes and the directions of the elastic forces F are uniform. Thus, it is possible to suppress a concern that the contact failure between the container-side terminal 25 and the apparatus-side terminal 62 will occur. Moreover, in the third shape P3, the positions of the contact sections 28 are different with respect to all of the container-side terminals 25 configuring the first container-side terminal group 25A, but the positions of the contact sections 28 may be different with respect to at least three container-side terminals 25. Also in this case, it is possible to reduce the wobbling of the container-side circuit substrate 22 and to stably provide the container-side circuit substrate 22. Thus, it is possible to suppress the contact failure between the container-side terminal 25 and the apparatus-side terminal 62.

Moreover, the terminals illustrated in FIGS. 6A to 6C and FIG. 7A to 7C have the shapes in which the first container-side terminal group 25A has five container-side terminals 25, but the number of the container-side terminals 25 may of course be four or less or six or greater.

Second Embodiment

Ink Cartridge

Figure 8A:
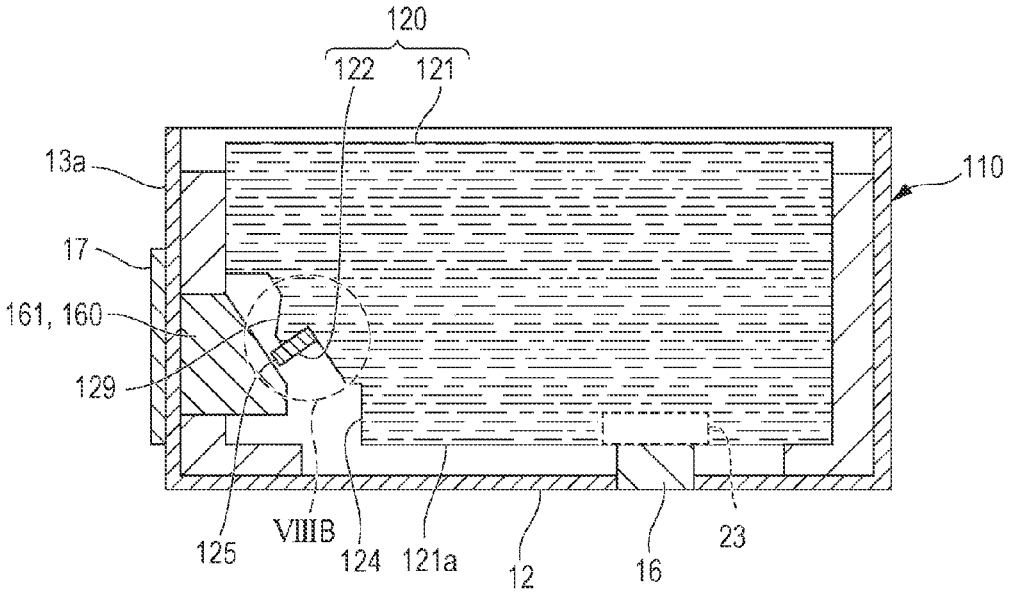
FIGS. 8A and 8B are cross-sectional views schematically illustrating a cartridge holder and an ink cartridge of a second embodiment.
Figure 8B:
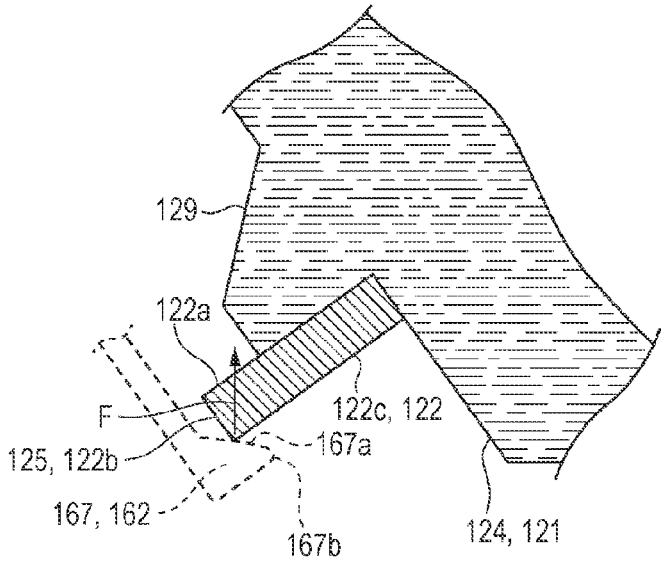

A second embodiment is a form in which a container-side circuit substrate 122 is mounted (inserted) on an ink cartridge 120 in an inclined posture. FIGS. 8A and 8B are cross-sectional views schematically illustrating the ink cartridge 120 and a cartridge holder 110 of the second embodiment, FIG. 8B is a partial enlarged view of a region VIIIB of FIG. 8A. Hereinafter, only a configuration different from that of first embodiment is described, the same reference numerals are given to the same configurations, and overlapping description will be omitted. In the second embodiment, a tube connecting section 16 is formed in a bottom portion 12 of the cartridge holder 110 and a terminal module 160 is disposed inside a front portion 13*a* of the cartridge holder 110. An apparatus-side circuit substrate 17 is mounted on the outside of the front portion 13*a* so as to overlap the terminal module 160. The terminal module 160 includes a housing 161 and an apparatus-side terminal 162 held in the housing 161. Moreover, in FIG. 8B, the housing 161 is not illustrated. One end (not illustrated) of the apparatus-side terminal 162 elastically comes in contact with a terminal (not illustrated) of the apparatus-side circuit substrate 17.

The ink cartridge 120 of the second embodiment includes a container body 121 in which ink is stored and a container-side circuit substrate 122. An ink supply section 23 is formed in the bottom portion 121*a* of the container body 121. If the bottom portion 121*a* is considered a first surface, the container body 121 is constituted by the first surface, a second surface that is an upper portion facing the first surface, a third surface that is a side portion intersecting the first surface and the second surface, a fourth surface that faces the third surface, a fifth surface that intersects the first surface to fourth surface, a sixth surface that faces the fifth surface, and a seventh surface 124 that is an inclined surface formed between the third surface and the first surface. An ink supply section 23 capable of supplying ink stored inside the container body 121 to the outside of the container body 121 is formed in the first surface that is the bottom portion 121*a*. Then, the container-side circuit substrate 122 is in a state of being mounted (inserted) on the seventh surface 124 that is the inclined surface in an inclined posture in a direction in which gravity acts. A position regulating section 129 protruding from the seventh surface 124 abuts a substrate surface 122*a* (see FIG. 8B) of one side of the container-side circuit substrate 122. A container-side terminal 125 is formed on a substrate end surface 122*b* (first surface) of the container-side circuit substrate 122. If the ink cartridge 120 is mounted on the cartridge holder 110, the other end of the apparatus-side terminal 162 of the terminal module 160 elastically comes in contact with the container-side terminal 125. Similar to the apparatus-side terminal 62 of the first embodiment, a substantially triangular first protrusion section 167 is formed in the other end of the apparatus-side terminal 162. An inclined portion 167*a* and a leading end portion 167*b* are formed in the first protrusion section 167.

Shape of Container-side Terminal

Figure 9A:
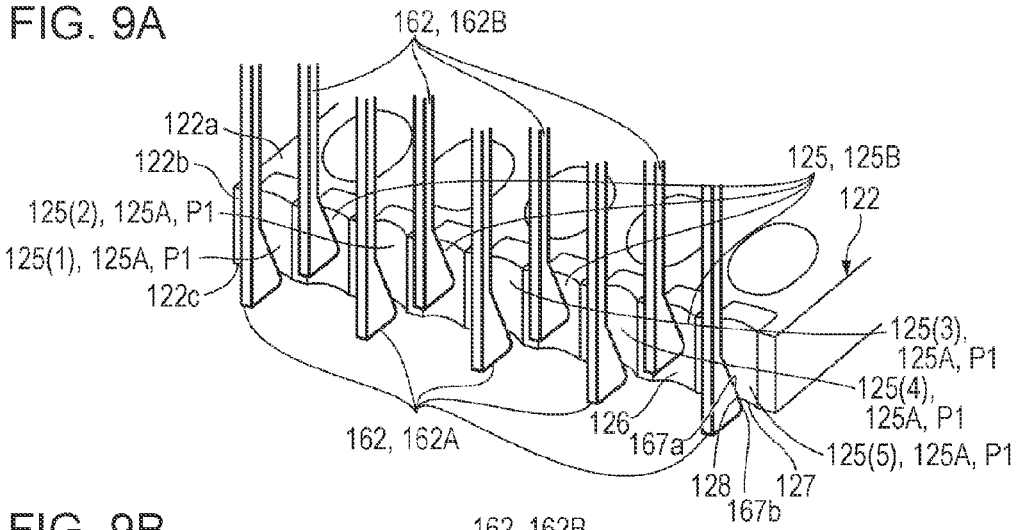
FIGS. 9A to 9C are perspective views of container-side terminals and apparatus-side terminals of the second embodiment.
Figure 9B:
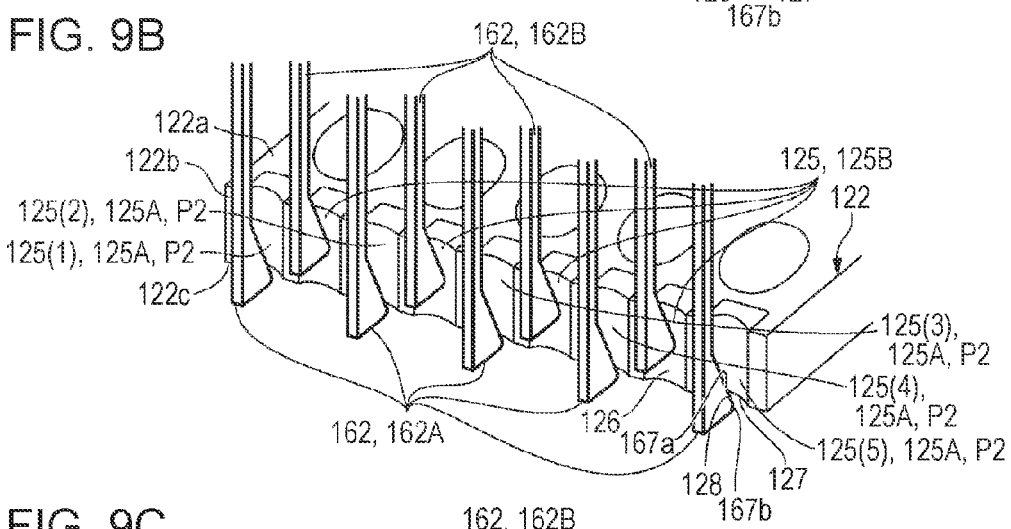
Figure 9C:
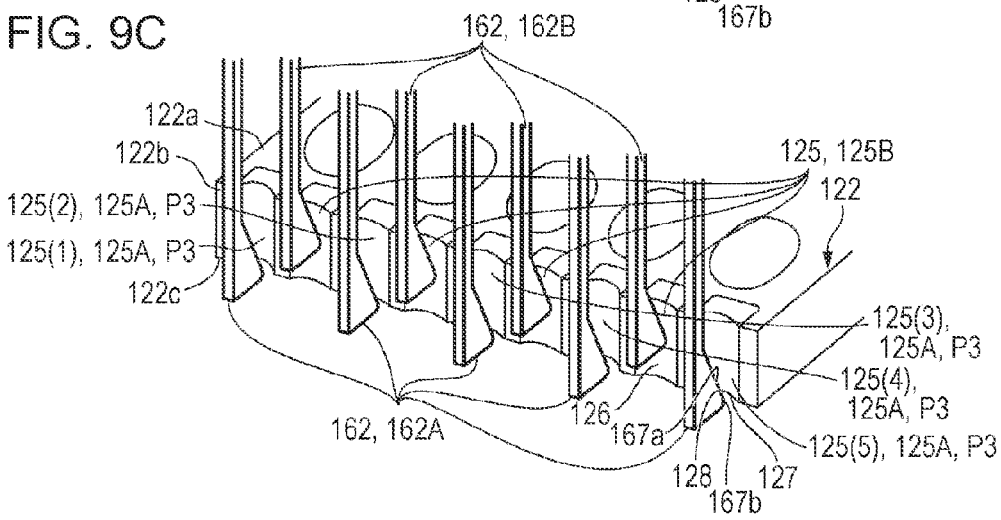
Figure 10A:
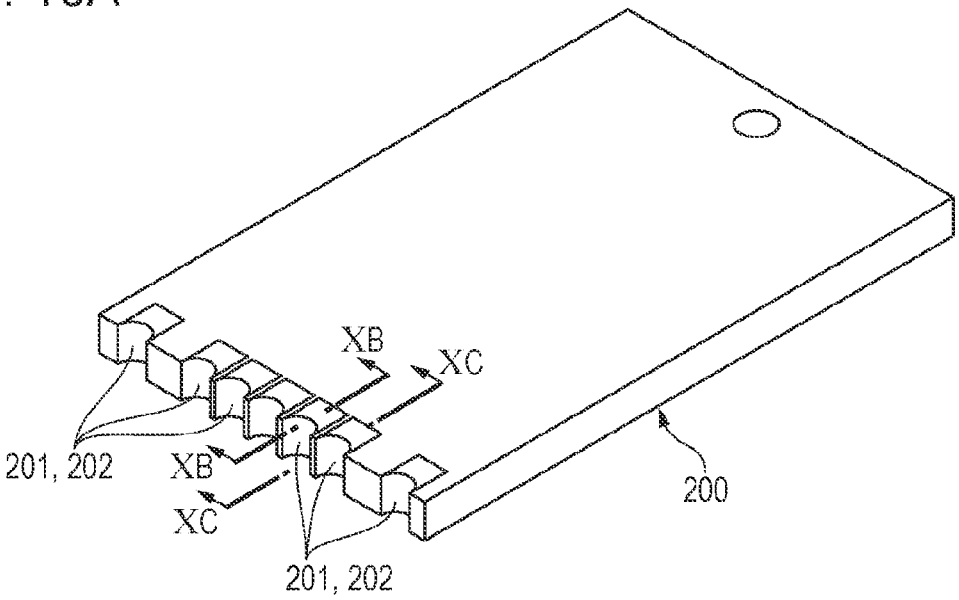
FIGS. 10A to 10C are explanatory views illustrating a contact state between an apparatus-side terminal and a container-side terminal of the related art.
Figure 10B:
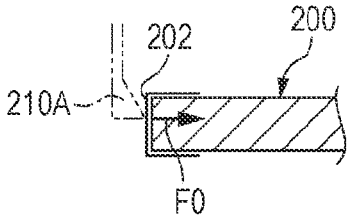
Figure 10C:
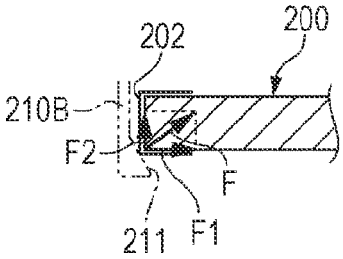

FIGS. 9A to 9C are perspective views of the container-side terminal 125 and the apparatus-side terminal 162. A plurality of container-side terminals 125 are formed in a first surface 122*b* of the container-side circuit substrate 122. The container-side circuit substrate 122 is constituted by the first surface 122*b*, a second surface (not illustrated) that faces the first surface, a third surface that intersects the first surface and the second surface, a fourth surface that faces the third surface, a fifth surface 122*a* that intersects the first surface to fourth surface, and s sixth surface 122*c* that faces the fifth surface 122*a*. A plurality of grooves 126 are recessed in a direction from the first surface to the second surface, extend in a direction in which the fifth surface faces the sixth surface in the first surface 122*b*, and are formed in a line in a direction in which the third surface faces the fourth surface. Then, curved edge portions 127 are formed in a corner portion formed by the first surface and the fifth surface and a corner portion formed by the first surface and the sixth surface. The container-side terminal 125 has a configuration in which a conductive layer of copper and the like is formed inside the groove 126, on a part of the fifth surface on a first surface side, and on a part of the sixth surface on the first surface side.

Similar to the apparatus-side terminal 62 of the first embodiment, the apparatus-side terminal 162 includes a first apparatus-side terminal group 162A formed of a plurality of apparatus-side terminals 162 in which the inclined portions 167*a* of the first protrusion sections 167 come in contact with the contact sections 128 of the edge portion 127 of the container-side terminal 125 and a second apparatus-side terminal group 162B formed of a plurality of apparatus-side terminals 162 in which leading end portions 167*b* of the first protrusion sections 167 come in contact with the inside of the groove 126. Then, the container-side circuit substrate 122 includes a first container-side terminal group 125A formed of a plurality of container-side terminals 125 including contact sections that come in contact with the apparatus-side terminals 162 of the first apparatus-side terminal group 162A and a second container-side terminal group 125B formed of a plurality of container-side terminals 125 including contact sections that come in contact with the apparatus-side terminals 162 of the second apparatus-side terminal group 162B. The first container-side terminal group 125A includes a container-side terminal 125(1) (first terminal), a container-side terminal 125 (2), a container-side terminal 125(3) (second terminal), a container-side terminal 125(4), and a container-side terminal 125(5) (third terminal).

FIGS. 9A to 9C illustrate shapes of three patterns in which the depths at which the grooves 126 are assembled are different. That is, FIG. 9A is similar to the first shape P1 of the first embodiment in that a depth L1 of the grooves 126 of the container-side terminal 125(1) and 125(5) is shaped to be shallower than a depth L2 of the grooves 126 of the container-side terminals 125(2) to 125(4) positioned therebetween. Furthermore, FIG. 9B is similar to the second shape P2 of the first embodiment and the depth L1 of the grooves 126 of the container-side terminal 125(1) and 125(5) positioned at both ends which is shaped to be deeper than the depth L2 of the grooves 126 of the container-side terminals 125(2) to 125(4) positioned therebetween. FIG. 9C is similar to the third shape P3 of the first embodiment and depths of the grooves 126 of the container-side terminals 125(1) to 125(5) which are shaped by being randomly set.

In shapes of three patterns in the second embodiment, contact states with the apparatus-side terminals 162 are the same as those of the shapes of three patterns in the first embodiment. Thus, the same advantages as those described in the first embodiment are achieved. That is, elastic forces F having values and directions which are not uniform obliquely act on a plurality of positions of the container-side circuit substrate 122 from the apparatus-side terminals 162 of the first apparatus-side terminal group 162A. Thus, it is possible to suppress a concern that positional shift or wobbling of the container-side circuit substrate 122 occurs. Thus, it is possible to stably provide the container-side circuit substrate 122 and it is possible to suppress the contact failure between the container-side terminal 125 and the apparatus-side terminal 162.

Furthermore, in the second embodiment, as illustrated in FIGS. 8A and 8B, the position regulating section 129 is formed in the container body 121 supporting the container-side circuit substrate 122. The position regulating section 129 is disposed on a side opposite to the apparatus-side terminal 162 of the terminal module 160 with respect to the container-side circuit substrate 122. That is, the position regulating section 129 is positioned with respect to the container-side circuit substrate 122 in a direction in which the elastic force F acts which is applied to the container-side circuit substrate 122 from the apparatus-side terminal 162 of the first apparatus-side terminal group 162A. Thus, the positional shift of the container-side circuit substrate 122 is regulated by the position regulating section 129. Thus, it is possible to suppress the positional shift or wobbling of the container-side circuit substrate 122 and it is possible to further stably provide the container-side circuit substrate 122. Thus, it is possible to suppress the contact failure between the container-side terminal 125 and the apparatus-side terminal 162.

The "Surface" in the first embodiment and the second embodiment may not necessarily be flat and unevenness may be formed thereon. Furthermore, the container-side terminal is not necessarily mounted on the liquid storage container and may be mounted on a connecting body such as an adapter mounted on the cartridge mounting section.

What is claimed is:

1. A liquid storage container that is configured to be mounted on a mounting section of a liquid ejecting apparatus having an apparatus-side terminal group that has elasticity and includes a first apparatus-side terminal and a second apparatus-side terminal arranged in one line, the liquid storage container comprising:

a container-side terminal group that includes a first terminal and a second terminal, the first terminal having a first contact section that comes in contact with the first apparatus-side terminal and the second terminal having a second contact section that comes in contact with the second apparatus-side terminal, wherein the first terminal is formed inside a first groove, and the second terminal is formed inside a second groove, a depth of the first groove being different than a depth of the second groove.

2. The liquid storage container according to claim 1, the container-side terminal group further including a third terminal having a third contact section that comes in contact with a third apparatus-side terminal included in the apparatus-side terminal group, and when a direction of an elastic force acting on the first contact section from the first apparatus-side terminal is a direction of elasticity and in a state where a contact section group is defined as a group of the contact sections configured to come in contact with terminals that are correspond of the apparatus-side terminal group, the first contact section and the third contact section are positioned on both sides of the contact section group, and positions of the first contact section and the third contact section are farther than a position of the second contact section in the direction of elasticity.

3. The liquid storage container according to claim 1, the container-side terminal group further including a third terminal having a third contact section that comes in contact with a third apparatus-side terminal, included in the apparatus-side terminal group, and when a direction of an elastic force acting on the first contact section from the first apparatus-side terminal is a direction of elasticity and in a state where a contact section group is defined as a group of the contact sections configured to come in contact with terminals that are correspond of the apparatus-side terminal group, the first contact section and the third contact section are positioned on both sides of the contact section group, and positions of the first contact section and the third contact section are farther than a position of the second contact section in a direction opposite to the direction of elasticity.

4. The liquid storage container according to claim 2, wherein the position of the first contact section and the position of the third contact section are different in the direction of elasticity.

5. The liquid storage container according to claim 2, wherein the position of the first contact section and the position of the third contact section are the same in the direction of elasticity.

6. The liquid storage container according to claim 3, wherein the position of the first contact section and the position of the third contact section are different in the direction of elasticity.

7. The liquid storage container according to claim 3, wherein the position of the first contact section and the position of the third contact section are the same in the direction of elasticity.

8. The liquid storage container according to claim 1, wherein in a state where the second contact section is positioned at the center of the contact section group and an X direction is defined as a direction in which a portion of the apparatus-side terminal group coming in contact with the contact section group is in a line, the contact section group is symmetrical with respect to a virtual line intersecting perpendicularly to the X direction through the second contact section.

9. The liquid storage container according to claim 1, further comprising:

a regulating section that regulates a movement of a circuit substrate on which the container-side terminal group is provided, wherein, when a direction of an elasticity force acting on the first contract section from the first apparatus-side terminal is a direction of elasticity, the regulating section is positioned in the direction of elasticity farther than the circuit substrate.

* * * * *